US007155769B1

(12) United States Patent
Baker

(10) Patent No.: US 7,155,769 B1
(45) Date of Patent: Jan. 2, 2007

(54) BACK SCRUBBER

(76) Inventor: Catherine Baker, 1104 Victoria Cir., Copperas Cove, TX (US) 76522

( * ) Notice: Subject to any disclaimer, the term of this patent is extended or adjusted under 35 U.S.C. 154(b) by 224 days.

(21) Appl. No.: 10/984,006

(22) Filed: Nov. 9, 2004

(51) Int. Cl.
*A47K 7/02* (2006.01)

(52) U.S. Cl. ..... 15/104.92; 15/244.1; 4/606; 601/136

(58) Field of Classification Search ..... 15/104.92, 15/244.1, 244.3; 4/606; 601/136
See application file for complete search history.

(56) References Cited

U.S. PATENT DOCUMENTS

D226,875 S 5/1973 Haworth, Jr. et al.
3,750,226 A 8/1973 Morgan
4,014,051 A 3/1977 Pettit
4,020,519 A * 5/1977 Robison ..... 15/104.92
4,696,068 A 9/1987 Kenner
D344,633 S 3/1994 Ali
6,647,564 B1 * 11/2003 Smith ..... 4/606

FOREIGN PATENT DOCUMENTS

CA 2207693 * 12/1998

* cited by examiner

*Primary Examiner*—Mark Spisich
(74) *Attorney, Agent, or Firm*—Donald R. Schoonover

(57) ABSTRACT

A back scrubber is contoured to be amenable to a wide range of user sizes and shapes and has a soap storage compartment so liquid soap can be stored between uses of the back scrubber.

1 Claim, 1 Drawing Sheet

BACK SCRUBBER

BACKGROUND OF THE INVENTION

1. Field of the Invention

The present invention relates to the general art of baths, and to the particular field of body scrubbers used in baths or showers.

2. Description of the Related Art

Many people enjoy showering to clean their body. However, many people have difficulty in scrubbing their back. People often employ a number of contortions and combinations of contortions and brushes or wash cloths to accomplish this objective.

Some people do not have the dexterity or flexibility to adequately clean their back. In such cases, his or her back may go unscrubbed.

Therefore, there is a need for a device which will make it easy for someone to scrub his or her back.

While the inventor is aware of several devices that can be used to assist a person in scrubbing his or her back, the devices of which the inventor is aware have several drawbacks. For example, the known devices may require the application of soap to the device each time the device is used. This may create a messy sponge or cloth that must dry out or be wrung out. Furthermore, it may require the application of soap each time the device is used, which may be wasteful.

Therefore, there is a need for a device which will make it easy for someone to scrub his or her back and which will be capable of storing soap between uses.

Still further, the devices known to the inventor do not conform to the user's back and the user must move or contort in order to make full use of the device. This may be uncomfortable, especially for a disabled person or for a very small or a very large person.

Therefore, there is a need for a device which will make it easy for someone to scrub his or her back and which will be amenable for use by a plurality of different users.

PRINCIPAL OBJECTS OF THE INVENTION

It is a main object of the present invention to provide a device which will make it easy for someone to scrub his or her back.

It is another object of the present invention to provide a device which will make it easy for someone to scrub their back and which will be capable of storing soap between uses.

It is another object of the present invention to provide a device which will make it easy for someone to scrub his or her back and which will be amenable for use by a plurality of different users.

SUMMARY OF THE INVENTION

These, and other, objects are achieved by a back scrubber that is contoured and which has a soap storage area. Liquid soap can be dispensed into the back scrubber into the soap storage area and will be stored between uses of the back scrubber.

Using the back scrubber embodying the present invention will permit a user to store soap between uses and will also be contoured for maximum comfort for all users.

BRIEF DESCRIPTION OF THE DRAWING FIGURES

DETAILED DESCRIPTION OF THE PREFERRED EMBODIMENT

Figure 1:
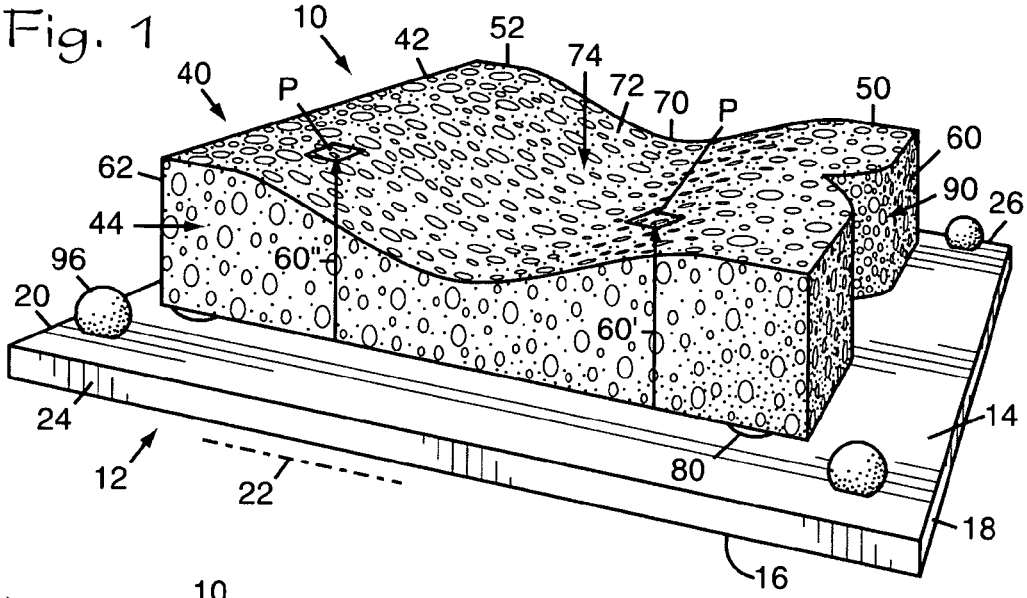
FIG. 1 is a perspective view of a back scrubber embodying the present invention.
Figure 2:
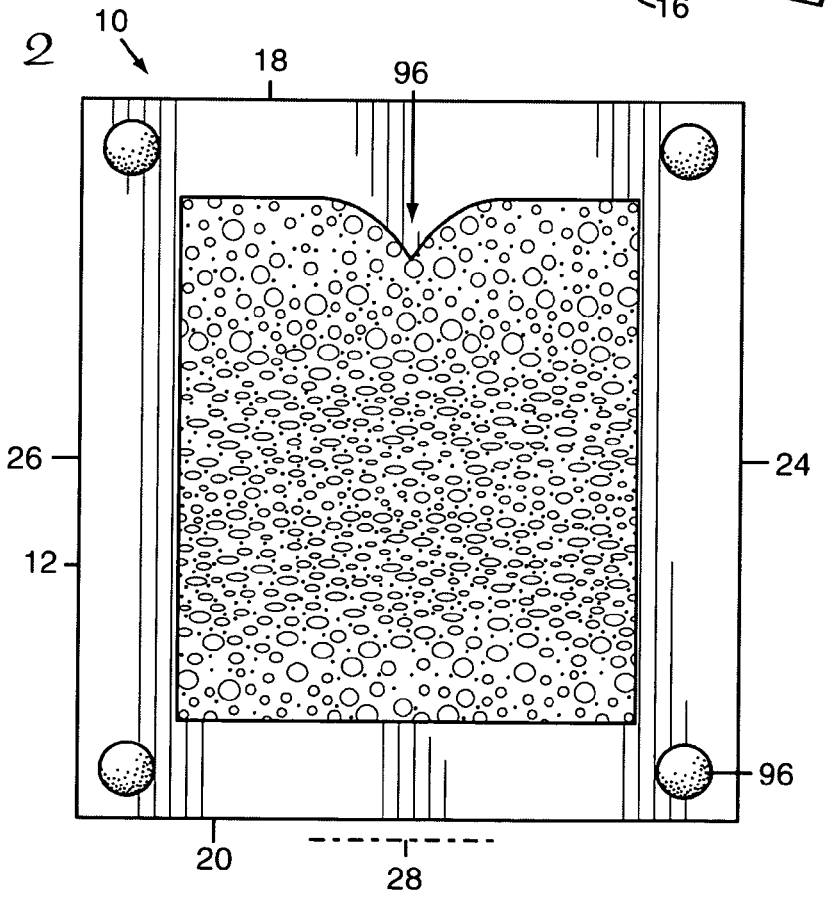
FIG. 2 is a top plan view of the back scrubber shown in FIG. 1.

Other objects, features and advantages of the invention will become apparent from a consideration of the following detailed description and the accompanying drawings.

Referring to the Figures, it can be understood that the present invention is embodied in a back scrubber 10 which achieves the above-stated objectives and which is mounted in a shower or tub for use while showering or bathing to scrub a person's back.

Back scrubber 10 comprises a base 12 which has a first surface 14, which is a front surface when base 12 is in use, and a second surface 16, which is a rear surface when base 12 is in use. Base 12 further includes a first end 18 which is a top end when base 12 is in use, a second end 20 which is a bottom end when base 12 is in use, and a longitudinal axis 22 which extends between first end 18 and second end 20. Base 12 further includes a first side 24, a second side 26, and a transverse axis 28 which extends between first side 24 and second side 26.

A sponge element 40 is mounted on first surface 14 of base 12. Sponge element 40 includes a first surface 42, which is an outer surface when sponge element 40 is in use, and a second surface 44, which is an inner surface when sponge element 40 is in use.

A first portion 50 of the sponge element 40 is located adjacent to first end 18 of base 12 and a second portion 52 is located adjacent to second end 20 of base 12.

The first surfaces of the first and second portions 50, 52 are arcuate and have common portions lying in common planes. That is, for example, a unit vector 60 extending between first surface 14 of base 12 and first surface 42 of first portion 50 of the sponge element 40 has a vector tip 60' that lies in a plane P, and a unit vector 62 extending between first surface 14 of base 12 and first surface 42 of the second portion 52 of the sponge element 40 has a vector tip 60" that lies in plane P. Unit vector 62 is located in second portion 52 at a location that corresponds to the location of unit vector 60 in first portion 50. The first and second portions 50, 52 of sponge element 40 are spaced apart from each other in the direction of longitudinal axis 22 of base portion 12.

A transition portion 70 connects the first and second portions 50, 52 together. Transition portion 70 has a first surface 72, that is an outer surface when sponge element 40 is in use, and a second surface 74, that is an inner surface when sponge element 40 is in use. All points on transition section 70 lie in planes that are spaced apart from common plane P toward base 14.

A plurality of suction cups, such as suction cup 80, are fixed on second surface 74 of sponge element 40. The suction cups are adapted to releasably hold the sponge element 40 onto base 12 when the base 12 is mounted in place on a support surface, such as a wall or the like.

A soap-accommodating storage unit 90 is located in sponge element 40 and includes a soap pocket 92 located near first end 18 of base 12. Soap pocket 92 is fluidically connected to sponge element 40 so liquid soap can flow from the soap pocket 92 to the sponge element 40 to be transferred to the outer surface 42 of the sponge element 40 for application to a user's back when the user rubs his or her back against the outer surface 42 of the sponge element 40. The contour shape of the sponge element 40 ensures even and comfortable application of soap to the user's back no matter how tall the user is.

A plurality of handles, such as handle 96, are fixed to the first surface 14 of base 12. The handles are located adjacent to sponge element 40.

Use of back scrubber 10 will be understood from the foregoing, and thus will be only briefly discussed. Back scrubber 10 is mounted on a wall adjacent to a bath tub or a shower so the sponge element 40 is located in a position to be convenient to one using the bath or shower. Liquid soap is poured into soap pocket 92 and once sponge element 40 becomes wet, the liquid soap is transferred to the outer surfaces 42 of the sponge element 40. A person then rubs his or her back against the sponge element 40 and soap will be transferred to the user's back simultaneously with a scrubbing action.

It is understood that while certain forms of the present invention have been illustrated and described herein, it is not to be limited to the specific forms or arrangements of parts described and shown.

What is needed and desired to be covered by Letters Patent is as follows:

1. A back scrubber comprising:

(a) a base having a first surface which is a front surface when said base is in use, a second surface which is a rear surface when said base is in use, a first end which is a top end when said base is in use, a second end which is a bottom end when said base is in use, a longitudinal axis which extends between the first end and the second end, a first side, a second side, a transverse axis which extends between the first side and the second side;

(b) a sponge element mounted on the first surface of said base, said sponge element including (1) a first surface which is an outer surface when said sponge element is in use, (2) a second surface which is an inner surface when said sponge element is in use, the second surface of said sponge element being in contact with the first surface of said base, (3) a first portion located adjacent to the first end of said base, (4) a second portion located adjacent to the second end of said base, (5) the first surfaces of the first and second portions being arcuate and having common portions lying in common planes, the first and second portions being spaced apart from each other in the direction of the longitudinal axis of said base portion, and (6) a transition portion connecting the first and second portions together, the transition portion including a first surface that is an outer surface when said sponge element is in use, a second surface that is an inner surface when said sponge element is in use, the second surface of the sponge element transition portion being mounted on the first surface of said base and having all portions thereof located to lie in a plane that is spaced apart from the common plane containing the points on the first surfaces of the first and second portions;

(c) a plurality of suction cups on the second surface of said sponge element and releasably holding said sponge element in place on said base element;

(d) a soap accommodating storage unit in said sponge element and including a soap pocket located near the first end of said base, said soap pocket being fluidically connected to said sponge element so liquid soap can flow from the soap pocket to said sponge element; and (e) a plurality of handles on the first surface of said base, said handles being located adjacent to said sponge element.

* * * * *